United States Patent [19]

Vindigni

[11] Patent Number: 5,044,977

[45] Date of Patent: Sep. 3, 1991

[54] ELECTRICAL CONNECTOR HAVING PRESSURE CONTACTS

[75] Inventor: Henry Vindigni, Alfortville, France

[73] Assignee: Societe d'Exploitation des Procedes Marechal (SEPM) S.A., Paris, France

[21] Appl. No.: 392,934

[22] PCT Filed: Nov. 25, 1988

[86] PCT No.: PCT/FR88/00580

§ 371 Date: Jul. 28, 1989

§ 102(e) Date: Jul. 28, 1989

[87] PCT Pub. No.: WO89/05532

PCT Pub. Date: Jun. 15, 1989

[30] Foreign Application Priority Data

Nov. 30, 1987 [FR] France ..... 87 16574

[51] Int. Cl.[5] ..... H01R 13/64; H01R 4/50; H01R 17/00

[52] U.S. Cl. ..... 439/374; 439/345; 439/660

[58] Field of Search ..... 439/374, 376, 378, 586, 439/593, 597, 660, 351, 352, 357, 358, 736

[56] References Cited

U.S. PATENT DOCUMENTS

| | | | |
|---|---|---|---|
| 3,982,804 | 9/1976 | Marechal | 339/41 |
| 4,014,343 | 3/1977 | Esty | 439/374 |
| 4,420,209 | 12/1983 | Reis et al. | 439/357 |
| 4,553,801 | 11/1985 | Zajeski | 439/350 |
| 4,684,192 | 8/1987 | Long et al. | 439/374 |

FOREIGN PATENT DOCUMENTS

| | | |
|---|---|---|
| 2510437 | 9/1975 | Fed. Rep. of Germany . |
| 2212655 | 7/1974 | France . |
| 2270696 | 12/1975 | France . |
| 2365872 | 4/1978 | France . |
| 2422270 | 11/1979 | France . |
| 2531577 | 2/1984 | France . |
| 1232168 | 5/1971 | United Kingdom . |

*Primary Examiner*—Larry I. Schwartz
*Assistant Examiner*—Julie R. Daulton
*Attorney, Agent, or Firm*—Sandler, Greenblum & Bernstein

[57] ABSTRACT

An electrical connector having a socket provided with pressure contacts. A plug is provided which is at least partially inserted in the socket. The connector is provided with a latching mechanism formed of a hook provided on the plug or socket which engages a spur provided on the socket or plug, respectively, when the plug is inserted in the socket. Either the socket or the plug, or both, are provided with at least one hump which projects from an interior surface of the plug or an exterior surface of the socket.

16 Claims, 2 Drawing Sheets

ELECTRICAL CONNECTOR HAVING PRESSURE CONTACTS

BACKGROUND OF THE INVENTION

1. Field of the Invention

The invention relates to an electrical connector having pressure contacts and more particularly to an improvement for such an electrical connector.

2. Discussion of Background and Relevant Information

The electrical connectors of this type comprise a socket provided with pressure contacts provided, for example, with a braid surrounded by a spring, as mentioned in French Patent 2,365,872 in the name of Applicant, or constituted by rocker elements as in French patent 2,422,270, or French patent 2,531,577 and its certificate of addition, likewise in the name of the same applicant, and a plug adapted to be inserted at least partially in the socket.

By virtue of the pressure exerted by the contacts and also that exerted by an ejection spring generally provided between the plug and the socket, so as to allow for a quick break (to avoid in particular the electric arc of breaking the circuit, etc.), it is necessary that the plug be retained in the socket by a latching means.

The latching means mentioned above is generally constituted by a hook provided on the socket and which is adapted to be in contact with a spur provided on the plug.

The hook is generally rockable by means of a pressure button.

These connectors may or may not comprise one or two safety discs, as disclosed, for example in French patents 2,212,655 and 2,270,696, in the name of the same applicant.

The insertion of connectors provided with at least one safety disc generally occurs in three steps: a pre-insertion axial movement, a rotation to align the respective contacts (the one or more discs thus undergoing this rotation), and a second axial pressure, until latching. The proper angular position of the plug and of the socket at the beginning of the maneuvers, as well as the translational and rotational guidance, are assured, for example, by a bayonet type system.

The connectors can, if desired, also comprise a sealing joint positioned between a portion of the plug and a portion of the socket.

It is desirable to provide only a single hook, so as to be able to allow for a sudden break of the current by relying upon it to free it, the contact springs and the ejection spring assuring the said break by sudden spacing of the plug and of the socket, the said plug being however, prevented from separating completely by the guidance means provided, as explained above (previously cited bayonet system, for example). In effect, a plurality of hooks would require a delicate manipulation if one desires that they be all freed in a synchronous manner so as to obtain the previously mentioned sudden break.

Under the effect of the pressure exerted, as explained above, by the contacts and by the ejection spring, the plug rests on the latching hook. It results necessarily that the plug is biased to turn around its retention point in a plane passing through its longitudinal axis and through the hook. In addition to a poor aesthetic appearance, the misalignment of the plug and of the socket plays a negative role, particularly on the efficacity of the contacts achieved (misalignment of the contacts of the plug with respect to those of socket), on the wear of the conductive braids, and on the sealing which can only be weakened by nonuniform crushing of the joint.

The solutions to this problem have been sought and studied for a long time.

To completely eliminate the above disadvantages, it has in particular been envisioned to multiply the number of latching means. Thus, certain electrical connectors comprise four hooks, or two hooks (with an insertion ring and/or bayonet system).

However, although these solutions may be appropriate for certain applications, they eliminate the advantage of having a single hook, as explained above.

This is why it has appeared until today, that the presence of a single hook necessarily had to be associated with the disadvantage of axial misalignment of the plug and of the socket. Given this situation, the research has been directed to two improvements: the limitation of inclination and the adaptation of this inclination.

To limit the inclination, it has been attempted to adjust, as best as possible, the diameters of the plug and of the socket, as well as the dimensions of the guidance means. However, it is clear that the tolerances of manufacturers resist the total elimination of a certain play between the plug and the socket.

With a view to adapting to the inclination, one positions the socket on a vertical wall, taking care preferably, that the hook be positioned upwardly. in a manner such that the weight of the cable connecting the plug makes it possible to compensate at least in part the said inclination.

With respect to the sealing, it has also been imagined to provide a joint which is thicker and/or has a lip and/or further has a nonconstant cross section.

Finally, one has also worked on the aesthetic aspects, by providing a rounding or an inclination of the surface of the socket, on the side of the plug.

It is clear that all of the means of limitation or adaptation mentioned above are gimmicks that do not resolve the question.

SUMMARY OF THE INVENTION

The inventor has in particular achieved in overcoming the prejudgment that a single hook necessarily caused inclination.

The electrical connector conceived by the inventor to resolve the problem posed is remarkable in that the plug and/or the socket comprises one hump which projects slightly with respect to the exterior surface of the plug or respectively, interior to the socket.

Preferably, the one or more humps of the socket and/or the plug are positioned in a plane passing through the longitudinal axis of the plug and of the socket and substantially through the latching means.

There exists a plurality of embodiments which are possible. According to one of the embodiments, the one or at least one of the humps of the plug is provided to the posterior portion thereof which is embedded in the socket and on the side of the latching means.

According to another embodiment, the one or at least one of the humps of the plug is provided towards the anterior portion which embeds in the socket and on the side diametrically opposed with respect to the latching means.

BRIEF DESCRIPTION OF THE DRAWINGS

In the same way, for at least one of the humps formed on the socket, one preferred embodiment envisions providing towards the anterior portion in which is embedded the plug and on the side of the latching means, while according to another embodiment, the hump is provided in the contrary towards the posterior portion in which is embedded the plug and on the side diametrically opposed to the latching means.

DETAILED DESCRIPTION OF THE INVENTION

The invention will be better understood with reference to the description which will follow and with reference to the annexed drawings which schematically represent an elevation with breakaway and partial cross section, a plug and a socket according to the invention.

Figure 3:
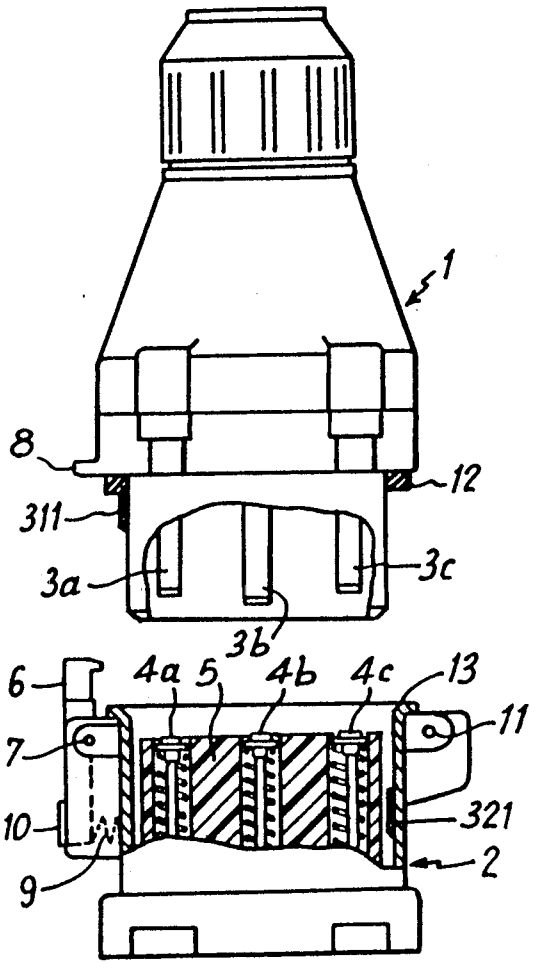
Figure 2:
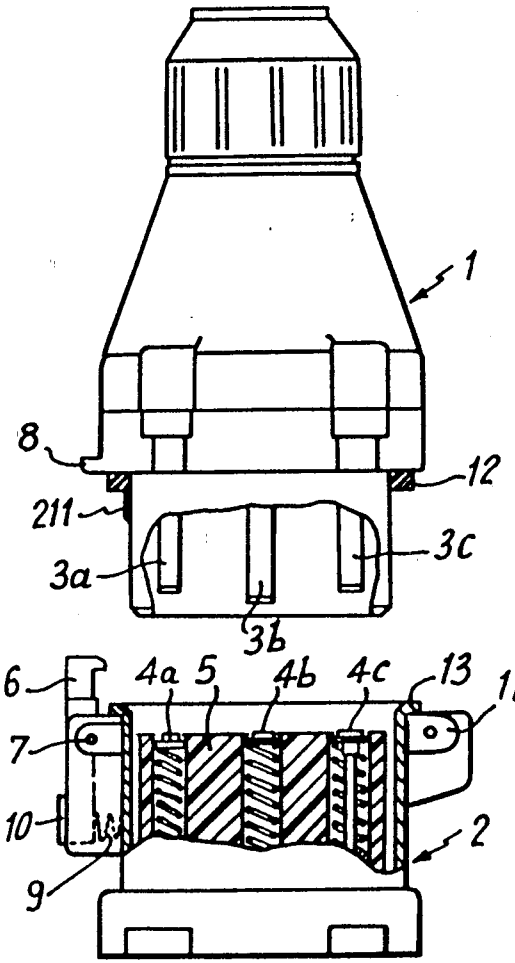
Figure 1:
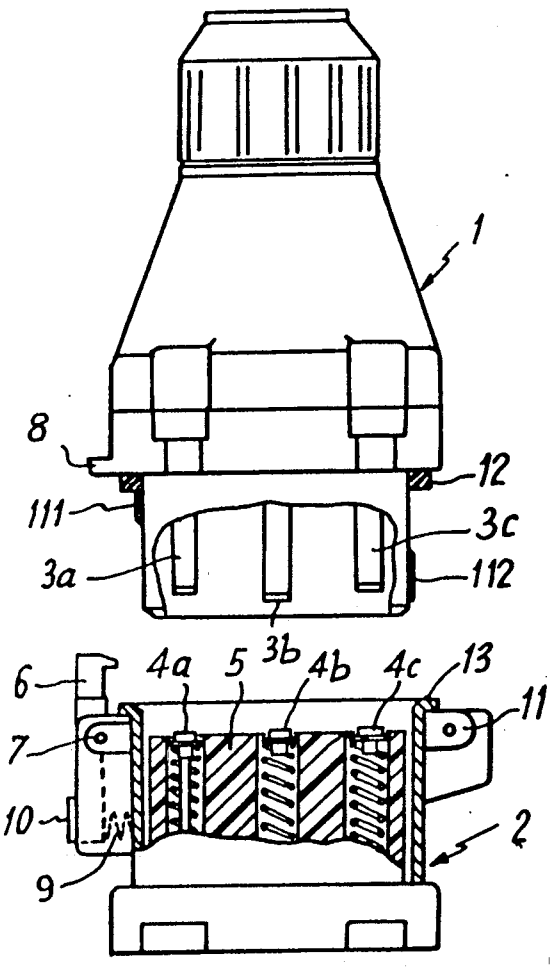
Figure 4:
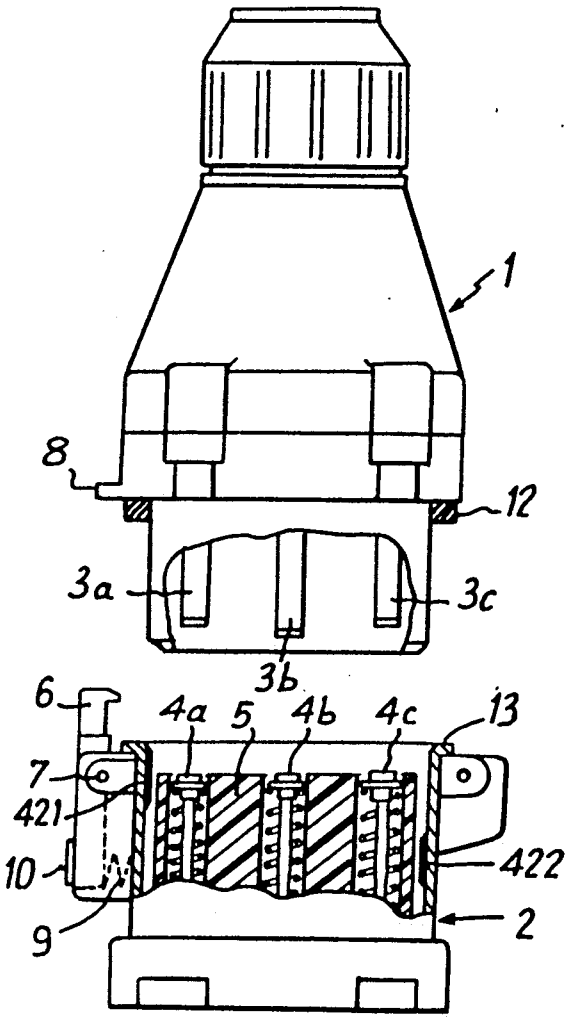
Figure 5:
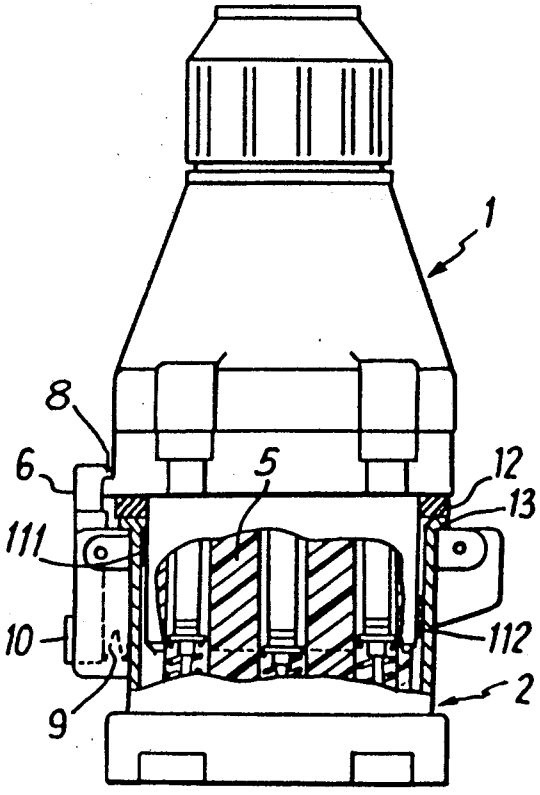
Figure 6:
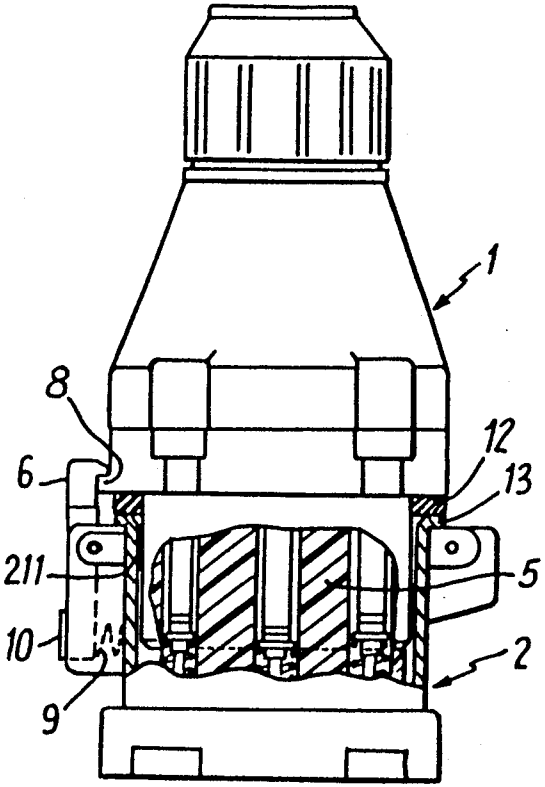

FIGS. 1–4 represent four different embodiments according to the invention, the connector being shown before insertion of the plug in the socket, and FIGS. 5 and 6 show the embodiments of FIGS. 1 and 2 after insertion.

FIGS. 1–6 illustrate a plug 1 adapted to be inserted in part in socket 2.

Plug 1 is provided with contact pins such as 3*a*, 3*b*, 3*c* and the socket with opposing contacts such as 4*a*, 4*b*, 4*c*.

The number and arrangement of the pins 3*a*–3*c* and of contacts 4*a*–4*c* depend obviously on the nature of the current to be transmitted. It is clear, also, as the drawings show, that the contacts 4*a*–4*c* are pressure end contacts constituted in a conventional manner by a conductor braid, a contact head, and a helicoidal spring surrounding the said braid, each contact being positioned in an appropriate housing in an insulated block 5 of socket 2.

As was said above, the plug and the socket are provided with means for guiding the insertion and means for retention (not shown) such as bayonet systems, for example. Furthermore, the socket and/or the plug can, of course, comprise one or more safety discs adapted to mask before insertion the contacts of the socket and/or the pins of the plug. Likewise, an ejection spring is in general provided for the reasons stated above.

However, so as to simplify the drawings, the connector according to the invention comprises only a minimum number of elements, it being understood, furthermore, that the invention applies also to this particularly simplified type.

The socket 2 comprises furthermore a hook 6, which is pivotably mounted around the axis 7 and which is adapted to be placed in contact with a spur 8 provided on the plug, as seen in the drawings (see particularly FIGS. 5 and 6).

A hook 6 is biased in the position shown in the drawings by a compression spring 9 while a press button 10 forming a lever allows by simple pressure to pivot the hook 6 against the bias of said compression spring 9. Furthermore, socket 2 is generally adapted to be in part embedded in a vertical wall and in this case, the hook 6 is then generally positioned upwardly on the (top of the socket).

Bearing 11 shown in the drawings is adapted to receive in a journalled fashion, a cover which is biased to closure by an appropriate spring and which is adapted to cover in a conventional manner the socket in rest.

The plug is furthermore provided with a joint 12 adapted to tighten on a front edge 13 of the socket at the end of the insertion maneuvers, as will be explained below (FIGS. 5 and 6).

FIG. 1 illustrates a plug 1 provided with two humps, 111 and 112, which project towards the exterior (for a better marking with respect to the humps, the hundreths number shows the number of the figure and the tenths number is the reference of the plug or respectively, of the socket on which it is provided). These two humps are provided in a plane passing through the longitudinal axis of the plug and of the socket and substantially through the latching means 6 and 8. This arrangement is furthermore utilized in the other embodiments shown.

However, the hump 111 is provided, as is shown in FIG. 1, towards the posterior portion of the plug which must be embedded in the socket and on the side of the spur 8, while the hump 112 is on the contrary provided toward the anterior portion and on the side diametrically opposed to the spur 8.

FIG. 2 shows an embodiment wherein the plug comprises only a single hump 211 of the type 111 in FIG. 1.

In FIG. 3, the plug also comprises a hump 311 of the same type as 111 and 211, but here the socket 2 is provided with an interior hump 321 provided towards the posterior portion in which is inserted the plug and on the side diametrically opposite to the hook.

In FIG. 4, only the socket is provided with humps 421 and 422, the later being equivalent to the hump 321 in FIG. 3, while the hump 421 is provided towards the anterior portion in which is inserted the plug and on the side of hook 6.

In fact, there exist a large number of possible embodiments. If one limits oneself to the preferred positions such as 111, 211, 311 (at the posterior and side spur) and 112 (anterior and opposite) for the plug and 421 (anterior and side hook), 321, 422 (posterior and opposite side) for the socket, certain possible and preferred embodiments are not shown. It is thus, for example, that the plug 1 of the FIG. 1 can comprise only hump 112, while socket 2, still in FIG. 1, can in this case comprise or not comprise a hump of the type 421 (FIG. 4). Likewise, for a plug 1 like that of FIG. 4 (without hump), socket 2 could have only one of humps 421 and 422.

However, to facilitate the insertion, it appears preferable that the hump of the plug be arranged as shown at 111, 211 and 311, while a hump of socket 2 will preferably be of the type 321 or 422, such that the embodiments of FIG. 2 and FIG. 3 are particularly advantageous.

In effect, the embodiment to FIG. 3 provides an easy introduction of the plug (hump at the posterior portion of the plug and a good equilibrium (hump opposite hump in the socket), while the embodiment of FIG. 2 is particularly simple, by offering furthermore the advantage of a plug which can be utilized with the previously existing sockets.

The insertion maneuvers depend on the guidance means provided which require, for example, a first translation, a rotation, and a final translation. In a particularly simple system, it is possible to imagine only an axial pressure and one then passes from FIGS. 1 and 2 to FIGS. 5 and 6, respectively.

It is clear that at the end of their extent, hook 6, which pivots first towards the exterior (by virtue of its shape) under the effect of spur 8 and against the bias of spring 9, then latches the assembly by folding to the rear of the said spur 8 under the effect of spring 9. An unlatching is easily obtained by pressing on button 10.

As FIGS. 5 and 6 show, the plug and the socket are perfectly coaxial and the joint 12 is crushed uniformly between the plug and the socket (otherwise stated, the surfaces facing the plug at the socket are perfectly parallel) and this, by virtue of the humps such as 111, 112 and 211.

Although FIGS. 5 and 6 illustrate more particularly the embodiments of FIGS. 1 and 2 after insertion, one can well imagine equivalent figures for embodiments of FIGS. 2, 3 and 4, as well as for the other embodiments not shown but mentioned above.

As can also be seen in the figures, the humps can have a slight bevel, at least on their attack edge, in a manner as so to facilitate insertion.

Finally, it is clear that each hump can be obtained directly by molding in the form on an applied appendage. The nature and the material of the humps depend, of course, on the material constituting the surfaces of the hump and of the socket on which they are provided, which can be metallic or synthetic.

It is clear, as previously stated, that the invention relates to a plurality of types of connectors, with or without sealing joint, with any number of contacts, etc.

What is claimed is:

1. An electrical connector having pressure contacts, comprising a socket provided with pressure contacts biased in an axial direction of said contacts, a plug adapted to be inserted, at least partially in said socket, said socket and said plug having a longitudinal axis when connected together, and latching means for attaching said socket and said plug, comprising a hook provided on one of either said socket or said plug, said hook adapted to be in contact with a spur provided on either one of said plug or said socket of said connector, said latching means being located on an outer surface of said connector wherein staid plug and/or said socket comprise at least one hump which projects slightly with respect to an exterior smooth mating surface of said plug or an interior smooth mating surface of said socket, said at least one hump contacting said smooth mating surface of said plug or socket, respectively, when said plug is inserted in said socket, said at least one hump being adapted to substantially prevent misalignment of said plug and said socket with respect to said longitudinal axis.

2. An electrical connector according to claim 1, wherein said one or more humps of said socket and/or said plug are positioned in a plane, passing through a longitudinal axis of said plug and of said socket substantially through said latching means.

3. An electrical connector according to claim 1, wherein said one or more humps of said socket and/or said plug is provided towards a posterior portion thereof which is inserted in said socket and on a side common to said latching means.

4. An electrical connector according to claim 1, wherein said plug is provided with at least one of said humps towards an anterior portion which is inserted in said socket and on a side diametrically opposite with respect to said latching means.

5. An electrical connector according to claim 1, wherein said socket is provided with at least one of said humps towards an anterior portion, in which is inserted said plug an on a side common to said latching means.

6. An electrical connector according to claim 1, wherein said socket is provided with at least one of said humps towards a posterior portion in which is inserted said plug and on a side diametrically opposite to said latching means.

7. An electrical connector according to claim 1, wherein said pressure contacts are biased in said axial direction toward an end in which is inserted said plug.

8. An electrical connector according to claim 1, wherein said pressure contacts are adapted to exert a pressure against pins of said plug when inserted in said socket.

9. An electrical connector comprising:

a socket provided with a plurality of pressure contacts and means for biasing said pressure contacts in an axial direction of said contacts;

a plug provided with a plurality of pins, said plug adapted to be inserted in said socket, said socket and said plug having a longitudinal axis when connected;

means for latching said plug and said socket together, located on an outside surface of said connector;

at least one hump formed on at least one of either an exterior smooth mating surface of said plug or an interior smooth mating surface of said socket, said hump being adapted to oppose said smooth mating surface thereby substantially preventing misalignment of said plug and said socket with respect to said longitudinal axis.

10. An electrical connector according to claim 9, wherein said means for biasing is a helicoidal spring.

11. An electrical connector according to claim 10, wherein said latching means further comprises a hook pivotably mounted on said socket and a spur provided on said plug, said hook adapted to engage with said spur when said plug is inserted in said socket.

12. An electrical connector according to claim 11, wherein said at least one hump is positioned in a plane which passes through a longitudinal axis of said plug and said socket, and substantially through said latching means.

13. An electrical connector according to claim 12, wherein said at least one hump of said socket and/or said plug is provided towards a posterior portion thereof which is inserted in said socket and on a side common to said latching means.

14. An electrical connector according to claim 12, wherein said plug is provided with at least one of said humps towards an anterior portion which is inserted in said socket and on a side diametrically opposite with respect to said latching means.

15. An electrical connector according to claim 12, wherein said socket is provided with at least one of said humps towards an anterior portion, in which is inserted said plug an on side common to said latching means.

16. An electrical connector according to claim 12, wherein said socket is provided with at least one of said humps towards a posterior portion in which is inserted said plug and on a side diametrically opposite to said latching means.

* * * * *